US006540170B2

(12) United States Patent
Tipton et al.

(10) Patent No.: US 6,540,170 B2
(45) Date of Patent: Apr. 1, 2003

(54) MULTIPLE COIL DISPENSER

(75) Inventors: Allison D. Tipton, Bloomingdale, IL (US); Richard G. Newman, Burlington, WI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/911,056

(22) Filed: Jul. 23, 2001

(65) Prior Publication Data

US 2003/0015619 A1 Jan. 23, 2003

(51) Int. Cl.[7] ..... B65H 23/06; B65H 19/10; B65H 23/04

(52) U.S. Cl. ..... 242/421.8; 242/422.8; 242/560; 242/566; 242/594.3; 242/615.3

(58) Field of Search ..... 242/421.8, 421.9, 242/422.8, 560, 594.3, 566, 615.21, 615.3

(56) References Cited

U.S. PATENT DOCUMENTS

| | | | | | |
|---|---|---|---|---|---|
| 2,510,187 | A | * | 6/1950 | Merrifield et al. | 242/421.8 |
| 2,637,509 | A | * | 5/1953 | Stanius | 242/421.8 |
| 2,905,406 | A | * | 9/1959 | Falck-Pedersen | 242/421.9 |
| 3,222,008 | A | * | 12/1965 | Purzycki | 242/421.9 |
| 3,228,624 | A | * | 1/1966 | Brinkman | 242/421.8 |
| 3,463,413 | A | * | 8/1969 | Smith | 242/421.8 |
| 4,012,001 | A | * | 3/1977 | Knox | 242/594.3 |
| 4,343,422 | A | * | 8/1982 | Helmut et al. | 242/615.21 |
| 4,905,927 | A | * | 3/1990 | Lesse | 242/421.8 |
| 4,917,285 | A | * | 4/1990 | Shosie | 242/560 |
| 6,059,160 | A | * | 5/2000 | Longrod | 242/615.21 |
| 6,086,011 | A | * | 7/2000 | Shibazaki et al. | 242/560 |

* cited by examiner

*Primary Examiner*—John M. Jillions
(74) *Attorney, Agent, or Firm*—Donald J. Breh; Mark W. Croll; Lisa M. Soltis

(57) ABSTRACT

A multiple coil dispenser supports a pair of coils for dispensing a flexible material from one of the coils. The dispenser includes a frame and at least one coil support for supporting the coils for rotation. A fixed arm is mounted to the frame and includes a plurality of rollers positioned longitudinally therealong. A movable arm is pivotally mounted to the frame for movement toward and away from the fixed arm. The movable arm has a plurality of rollers positioned longitudinally therealong and is biased away from the fixed arm. A bifurcated chute directs the strapping material from one of the coils to the arms. A brake assembly is operably connected to the movable arm between an engaged position when the movable arm is moved away from the fixed arm and a disengaged position when the movable arm is moved toward the fixed arm. A space between the fixed arm and the movable arm defines an accumulation region that varies in size as the movable arm moves toward and away from the fixed arm.

24 Claims, 3 Drawing Sheets

MULTIPLE COIL DISPENSER

BACKGROUND OF THE INVENTION

Coil dispensers are used as a source or supply of coil material for many operations. In one application, strapping material is supplied on a coil for use in a strapping machine. Various types of strapping machines are well known in the art and will be recognized by those skilled in the art.

The strapping material is fed from the coil to the strapping machine. The coil is supported on a coil dispenser. The dispenser provides a controlled source of the strapping material to the strapping machine. Functionally, the dispenser must permit feeding the strapping material to the strapping machine (when there is a demand) with little resistance on the material. The dispenser must also, however, prevent the coil from free-rolling (free rotation) whereby strapping material continuously feeds from the coil when there is no demand for strapping material To this end, the dispenser must include provisions to slow or brake the coil from free rotation upon a drop in demand.

One known dispenser includes a shaft about which the coil is mounted for rotation. A circular side plate is mounted to a side of the coil for rotation therewith. The shaft is positioned on a frame. To install a strapping material coil, the dispenser is opened, the side plate is removed and laid on a side. The coil is positioned on the plate, and the plate and coil are reinstalled on the dispenser.

The dispenser includes a dancer arm that pivots about the coil shaft. A roller is positioned at an end of a dancer arm opposing the arm axis of rotation. A brake assembly is mounted to the dancer arm for movement into and out of engagement with the side plate. The dancer arm is biased such that the brake is in engagement with the side plate.

The dispenser includes a second roller spaced from the dancer arm roller, mounted to the frame. Strapping material is fed from the coil, around the dancer arm roller and the frame roller. The strapping material is then fed to the strapping machine. As demand increased, the dancer arm pivots, disengaging the brake. Demand on the strap accelerates the coil, thus dispensing strap therefrom As demand drops, the dancer arm returns to its braking state, and the coil is slowed to prevent free-rolling and non-demand feed.

Another type of single coil dispenser includes a fixed arm and a dancer arm. The dancer arm pivots about an axis of rotation spaced from the coil axis. Each the dancer arm and the fixed arm include a plurality of rollers positioned one adjacent the other (i.e., side-by-side), at an end of the respective arms. The dancer arm is biased away from the fixed arm so as to increase the distance therebetween. This provides an accumulation region in which a length of strapping material accumulates in a controlled and ordered arrangement as it is drawn from the coil. This dispenser includes a complex arrangement of chains and sprockets to provide a braking force to prevent free-rolling of the coil.

Although both of these dispensers work well for their intended functions, they both have their drawbacks. In the single arm dispenser arrangement, the speed at which strapping material can be supplied (or drawn from the coil) is limited. That is, although this type of dispenser works well with slower speed strapping machines (those operating at about 5 feet of strap consumed per second) it does not function well with faster machines. Specifically, in this dispenser arrangement, there is no region for significant "accumulation" of strap that can be fed to the strapping machine from the dispenser at rest. As such, when used with faster strapping machines, this dispenser has been found to cause binding of the strapping machine feed wheels due to its slow delivery of strapping material.

While these drawbacks may be addressed by the two arm dispensers, this dispenser is quite costly to manufacturer and is complex in design. Specifically, the braking arrangement, which uses chains and sprockets, greatly increase the cost of the dispenser while at the same time increasing the complexity of the overall device. In addition, because the fixed and movable dancer arms each include a plurality of side-by-side rollers, when new strapping material is fed to the strapping machine, it must be laced or threaded around these rollers. In that these rollers are arranged side-by-side with one another, this lacing or threading can be quite time consuming and confusion can result.

In addition, it has been found that both of these arrangements require considerable time and manpower when replacing a coil of strapping material. In addition, when replacing a coil of strapping material, the strapping machine must be taken out of service until a new coil is placed on the dispenser and the dispenser placed back in service. This increases the "downtime" of the machine and can adversely impact the overall manufacturing or packaging operation.

Accordingly, there exists a need for a coil dispenser for dispensing strapping material from a coil. Preferably, such a dispenser includes provisions for mounting multiple coils thereto to reduce downtime when replacing strapping material coils. More desirably, such a dispenser provides sufficient accumulation of strapping material so that high-speed strapping operations are fully supported. Most desirably, such a dispenser permits straight forward use with minimal lacing required when starting new coils. Further, such as dispenser uses a stem that is readily accessible for operator attention.

BRIEF SUMMARY OF THE INVENTION

A multiple coil dispenser supports at least two associated coils for dispensing a flexible material from one of the coils. The dispenser includes a frame and at least one coil support for supporting the associated coils for rotation.

A fixed arm is mounted to the frame and includes a plurality of rollers positioned longitudinally therealong. Preferably, the arm is mounted to the frame at an upward angle.

A movable or dancer arm is mounted for movement toward and away from the fixed arm. Preferably, the movable arm is biased, by a spring, away from the fixed arm. In a present embodiment, the movable arm pivots toward and away from the fixed arm. The movable arm, like the fixed arm, has a plurality of rollers positioned longitudinally therealong. The fixed arm rollers and the movable arm rollers are disposed on their respective arms to nest with one another when the movable arm is disposed adjacent the fixed arm.

In a current embodiment, retainers are associated with at least some of the rollers. The retainers can be configured as one or more retainer brushes, each disposed to contact strapping material between it and its respective roller. Alternately, the retainers can be configured as secondary rollers disposed to maintain contact of the strap with the (primary) rollers.

The dispenser includes a brake assembly operably connected to the movable arm between an engaged position when the movable arm is moved away from the fixed arm and a disengaged position when the movable arm is moved toward the fixed arm. The brake assembly can be configured as a sheave mounted for rotation with the associated coils and a braking belt fixedly mounted to the dispenser at a first end and mounted to the movable arm at a second end. The braking element is configured to apply a braking force to the sheave to stop rotation of the coil as the movable arm moves (pivots) away from the fixed arm.

The arms define a space or accumulation region therebetween. The accumulation region varies in size as the movable arm moves toward and away from the fixed arm. That is, the accumulation region increases in size as the movable arm moves away from the fixed arm and decreases in size as the movable arm moves toward the fixed arm. In this manner, a significant amount of strap is accumulated in the accumulation region when the movable arm is farthest from the fixed arm.

In order to facilitate feeding strap from either of the coils to the centrally positioned arms, the dispenser includes a bifurcated strap chute. The chute includes two first or feed sections and an outlet section. Between inlets and a juncture with the common outlet, at the feed sections, the chute sections can include first and second, reversing helical sections. The helical sections facilitate redirecting the strap from the location at which the strap leaves the coil, to a central location for traversing through the fixed and movable arms.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
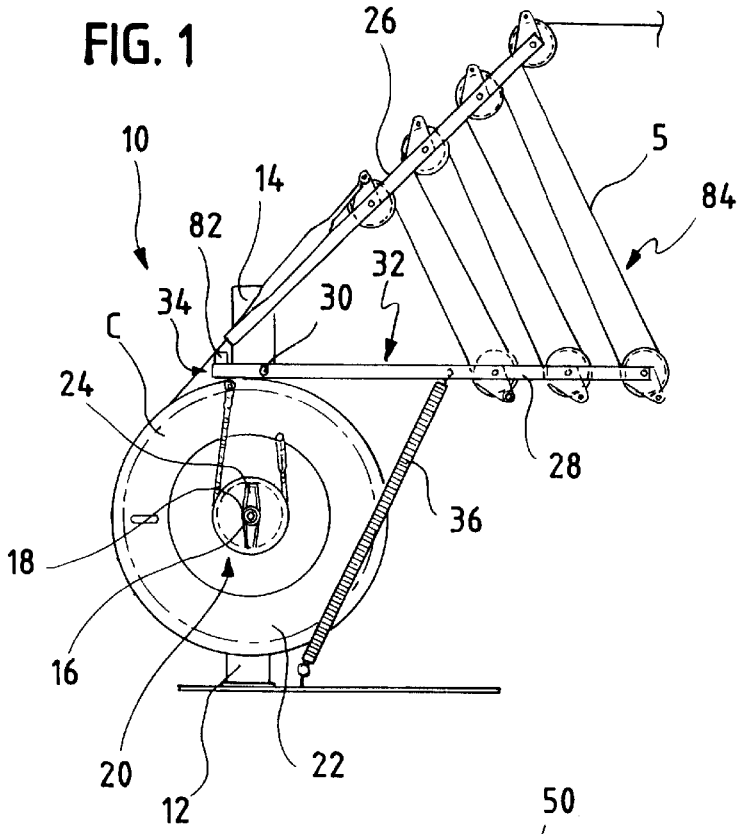
FIG. 1 is a side view of a multiple coil dispenser embodying the principles of the present invention, the dispenser being shown with the dancer arm at about the mid or steady-feed position.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1 there is shown a multiple coil dispenser 10 embodying the principles of the present invention. The dispenser 10 includes a frame 12 having a central upright or support 14. The illustrated dispenser 10 is configured to accommodate a pair of coils C for feeding strapping material S therefrom.

The dispenser 10 is configured to feed a flexible material, such as strapping material S from one of the coils C to, for example, a strapping machine (not shown). Those skilled in the art will recognize and appreciate the various types of strapping machines commercially available. The present dispenser is intended for use with an automatic type strapper, in which strapping material is fed by a drive assembly around a load, tensioned and sealed to itself.

The speeds at which these machines operate is increasing. Likewise, the automation with which they operate is also increasing. To this end, dispensers 10 require operation at high speeds (up to or more than 10 feet per second of strapping feed), and their design must take into consideration less operator attention. The present dispenser 10 achieves these ends by permitting such high speed use, while same time, using a simplified design, particularly in its refeeding, coil replacement and braking arrangements.

The coils C are positioned in a side to side relation to each other on opposing sides of the frame upright support 14. An axle or spindle assembly 16 supports the coils C and includes a shaft 18 for mounting the coils C thereto, brake means 20 such as the illustrated exemplary brake assembly, outer plates 22 or covers that are disposed over the sides of the coils C and hubs 24 for locking the coils C onto the spindle 16.

Figure 2:
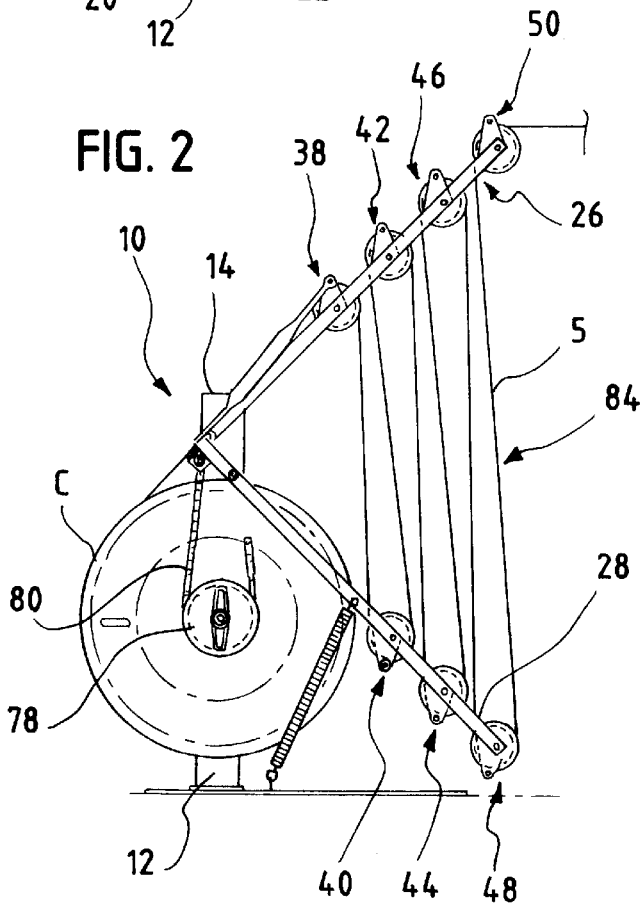
FIG. 2 is a side view similar to FIG. 1 illustrating the dancer arm at the lower or low-feed position.

The dispenser 10 includes a first fixed or boom arm 26 that is fixedly mounted to the frame 12. In a current embodiment, the fixed arm 26 is mounted to the upright at an upward angle. The dispenser 10 further includes a movable or dancer arm 28 that is mounted for pivotal movement relative to the fixed arm 26 and the upright support 14. In a current embodiment, the dancer arm 28 is mounted to the upright 14 by a shaft or pin 30 for pivotal movement relative to the upright 14. The dancer arm 28 includes a forward portion 32 on one side of the pivot pin 30 and a rear portion 34 on the opposing side of the pivot pin 30. A biasing element 36, such as the exemplary coil spring, is mounted at one end to the dancer arm forward portion 32, spaced from the pivot 30, and is mounted at the opposing end to the frame 12. The spring 36 biases the dancer arm 28 into the lower or low-feed position, as seen in FIG. 2.

Figure 3:
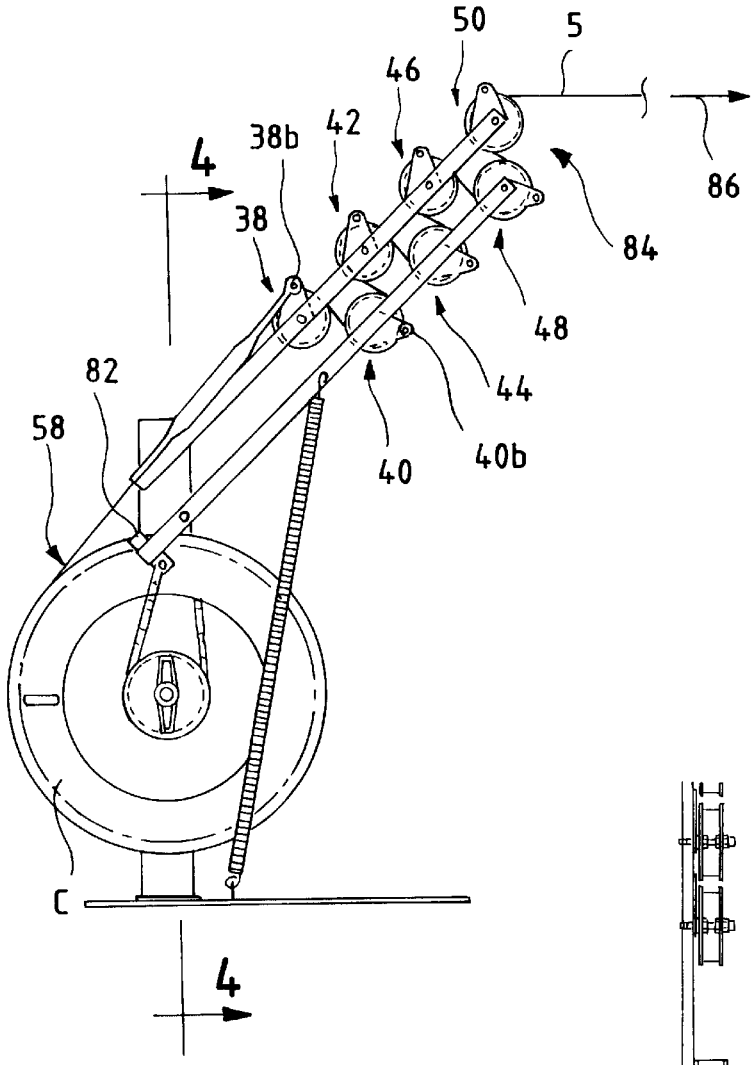
FIG. 3 is a side view similar to FIGS. 1 and 2 illustrating the dancer arm at the upper or fast-feed position.

Unlike known dispensers, the present multiple coil dispenser 10 includes roller means to facilitate movement of the strapping material S through the arms 26, 28. In the illustrated embodiment, the arms 26, 28 include a plurality of roller assemblies 38–50 extending along the length of each the arms 26, 28. In the illustrated embodiment, four roller assemblies 38, 42, 46 and 50 are positioned along the fixed arm 26 and three roller assemblies 40, 44 and 48 are positioned along the dancer arm 28. As is apparent from FIGS. 1–3, the roller assemblies 38–50 are positioned along the fixed and dancer arms 26, 28 so that they do not fully align with the roller assemblies on the opposing arm. That is, the dancer arm roller assemblies 40, 44, 48 "nest" between the fixed arm roller assemblies 38, 42, 46, 50. Thus, roller assembly 40 lies between roller assemblies 38 and 42, roller assembly 42 lies between roller assemblies 40 and 44, roller assembly 44 lies between roller assemblies 42 and 46, and so on. In this manner, as seen in FIGS. 1–3, strapping material S traverses from and between successive roller assemblies without significant overlap, and without significant touching of adjacent strapping courses.

Figure 6:
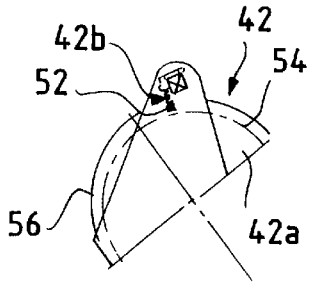
FIG. 6 is a partial, enlarged view of a roller assembly retainer brush positioned thereon.

Each of the assemblies 38–50 includes a primary roller 38*a*–50*a* about which the strap S traverses, and a retainer 38*b*–50*b*. The retainers 38*b*–50*b* can be formed as a secondary roller, such as 38*b* and 40*b*, that is positioned to maintain the strapping material S between the secondary roller 38*b*, 40*b*, and its respective primary roller 38*a*, 40*a*. The retainer can also be configured as a brush, such as 42*b*–50*b* and as is illustrated in FIG. 6. The brush includes a flexible bristle portion 52 that is configured to maintain contact with the strap S as it resides on the roller 42*a*. In this manner, the brush 52 retains the strap S on the roller 42*a* and further sweeps any dust or debris from the strap S as it traverses through the dispenser rollers 42–50. It has been found that such a brush 52 reduces the collection of debris later in the strapping operation, such as by a strapping machine weld head.

Each of the primary rollers 38*a*–50*a* includes a strap surface 54 (shown in phantom lines) and guides or side walls 56 extending outwardly (upwardly) from the strap surface 54 to maintain the strap S within the roller assemblies 38–50.

Figure 4:
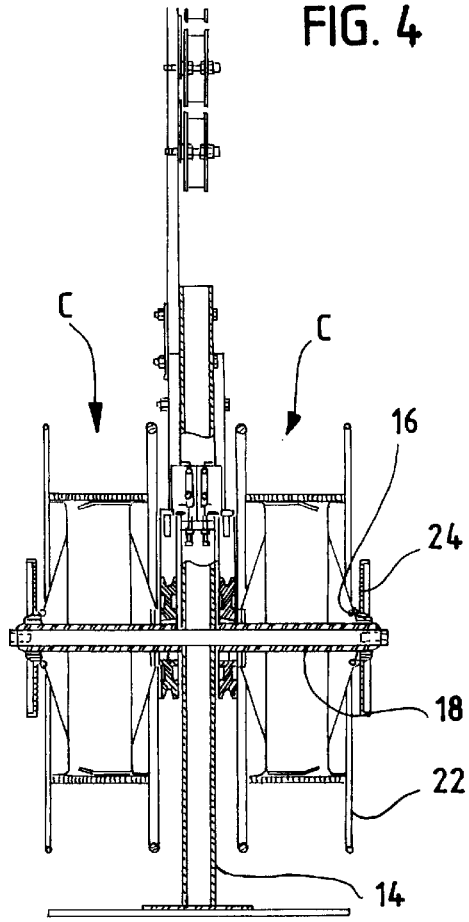
FIG. 4 is a partial cross-sectional view of the dispenser taken along line 4—4 of FIG. 3.
Figure 5:
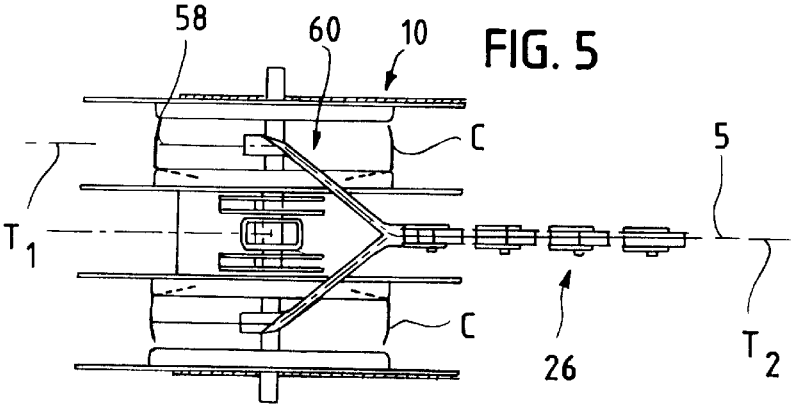
FIG. 5 is a top view of the dispenser illustrating the split strap chute.
Figure 7A:
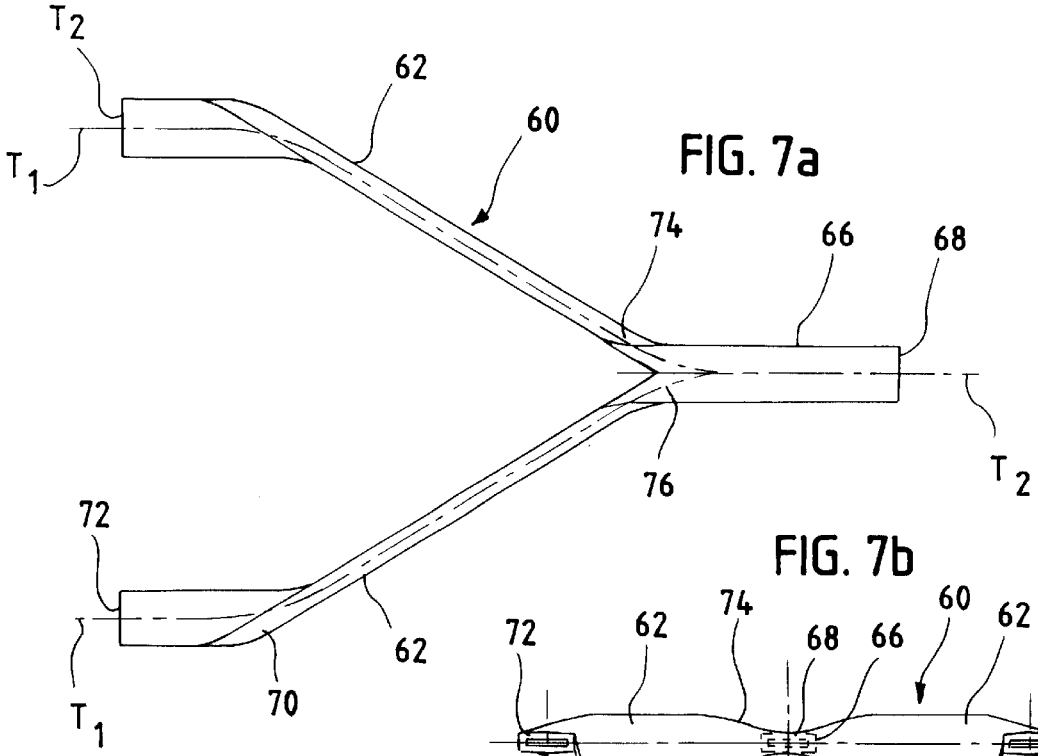
FIGS. 7*a–c* are top, front and side views of the bifurcated or split strap chute.
Figure 7B:
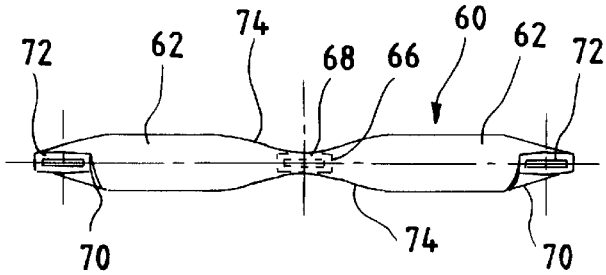
Figure 7C:
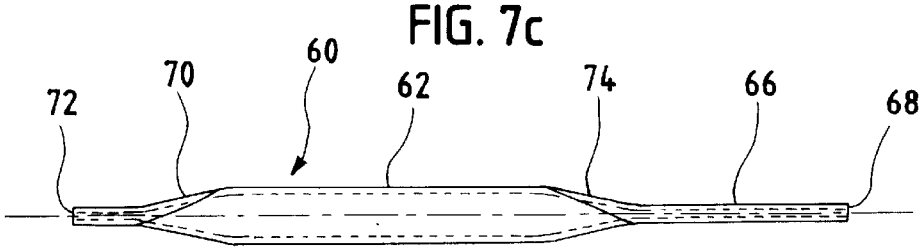

Referring now to FIG. 4, the present multiple coil dispenser 10 accommodates a pair of coils C using common fixed and dancer arms 26, 28. To this end, in order to provide a path from the point of the strap departing the coil C, as indicated at 58, to the fixed arm 26, as best seen in FIGS. 7*a–c*, the dispenser 10 includes chute means, as exemplified by the split or bifurcated chute 60 that is mounted to the frame 12, between the coils C.

The chute 60 includes a pair of substantially mirror image first or feed sections 62 joining one another to form a common chute portion 66. The common chute portion 66 terminates at a single, common outlet 68. In order to maintain the strap S in a proper orientation as it is fed from the coil C to the arms 26, 28, the feed sections 62 have a reversing helical profile with a first twist (indicated at 70) adjacent the inlets 72 and a second, reversing twist (indicated at 74) at the juncture 76 forming the common chute portion 66.

The chute 60 permits receiving the strap in one line of travel $T_1$ and transferring or conveying that S strap to a parallel line of travel $T_2$ without effecting an undesirable twist in the strap S. The chute 60 is configured to maintain the strap S consistently therethrough, without permitting rotation or twisting of the strap S.

Referring again to FIGS. 1–3, there is seen the braking means 20, shown as one embodiment of a braking arrangement. In a current embodiment, the brake 20 is common to both coils C. Alternately, a brake can be associated with each of the coils. The brake 20 includes a brake member or sheave 78 that is mounted for rotation with the coil C, and a brake element 80. The brake element 80 is a flexible element that is affixed at one end to the frame 12, traverses around the sheave 78, and is fixed at another end to the dancer arm rear portion 34. As will be readily apparent from the figures, when the dancer arm 28 is in the lower position (FIG. 1), the brake element 80 is pulled taut around the sheave 78. This provides a friction stop for rotation of the coil C. Conversely, when the dancer arm 28 is in the upper position (FIG. 3), there is reduced tension on the brake member 78, thus permitting free rotation of the coil C.

In a present embodiment, the brake element 80 is a belt, such as a clutching fabric V-belt. The belt 80 is sufficiently flexible to wrap around the sheave 78, while at the same time, sufficiently strong to provide the necessary braking force. In a present embodiment, the dancer arm 28 includes a stop 82 at the rear end 34 proximal the location at which the belt 80 is affixed to the arm 28. The stop 82 prevents over rotation of the dancer arm 28 beyond the lower position. Presently, the stop 82 prevents rotation of the dancer arm 28 beyond about 45° from the horizontal.

The function and operation of the dispenser 10 will now be described with reference to FIGS. 1 through 3 and with reference to the operation of a strapping machine. In a typical strapping machine, strap is required to be supplied (i.e., demand) when the strap is fed around the load to be strapped or bundled. When the strap has completed its traversal around the load, the strap demand drops so that the strapping machine can carry out all the necessary functions such as strap tensioning, cutting and welding. Subsequently, strap is re-fed through the strapping machine for bundling of another load.

Those skilled in the art will recognize that the demand from a strapping machine, rather than being a steady demand, is cyclical. That is, there is an immediate demand for a certain amount of strapping material after which demand drops. Demand then resumes for subsequent strapping operations. It will also be recognized that the demand is almost immediate. That is, the acceleration of the strapping material is quite high, up to the feed rate of about 10 feet per second. Moreover, the drop in demand is likewise almost immediate.

It has also been found that feeding strapping material directly from the coil cannot accommodate these high demand cycles. That is, the coil cannot accelerate fast enough to maintain a steady feed of strap to the strapping machine without producing a significant amount of resistance or drag on the strap. Thus, it is desirable to have a dispenser in which, in an accumulation region, strap is accumulated off of the coil, in an ordered arrangement that can be fed to the strapping machine with little to no or controlled resistance.

The present dispenser 10 is configured to accommodate this high and cyclical demand pattern and in particular is configured to accommodate this demand when made by modem high speed-strapping machines.

To this end, when the demand for strap S has dropped, the biasing element 36 pulls or urges the dancer arm 28 to the lower or low-feed position (FIG. 2). As set forth above, when the arm 28 is moving to this lower position, the brake 20 begins to engage to slow rotation of the coil 20. However, as the arm 28 moves to this position (before the arm 28 is fully at the lower position), the brake 20 is not fully engaged, and strapping material continues to be pulled (or fed) from the coil C. That is, strapping material S feed slows with increased braking. Once the arm 28 reaches the (full) lower position, the brake 20 is fully engaged preventing further rotation (and feeding from) the coil C.

In addition, because of the spaced relationship between the dancer arm 28 and the fixed arm 26, a substantial accumulation of strap S occurs as the strap S traverses between the rollers 38–50 in the accumulation region 84. In the present dispenser 10, an accumulation of about 22 feet of strapping material is provided.

Referring now to FIG. 3, at the point of first demand of the strapping machine, strap S is urged from the dispenser 10 as indicated by the arrow at 86. At this high-feed position, when the strap S is "pulled," (prior to which point in time the coil C is stopped) the dancer arm 28 is pulled upwardly (against the force of biasing element 36) and the strap S in the accumulation region 84 between the fixed and movable dancer arms 26, 28 supplies the strapping machine. At the same time, because the dancer arm 28 has been urged upwardly, the brake 20 is released to At rotation of the coil C. As the coil C rotates and as strap S demand continues, strap S is dispensed from coil C through the rollers 38–50.

After the immediate call for demand, and as steady demand continues, strap S continues to be fed from the coil C into the accumulation region 84 between the fixed arm 26 and the dancer arm 28. As such, because there is less resistance on the coil C (because the brake 20 has been released and because the coil C is already rotating) the biasing element 36 begins to urge or pull the dancer arm 28 downwardly. As the dancer arm 28 continues to be urged downwardly, accumulation continues within the accumulation region 84. As such referring to FIG. 1, there is seen the dancer arm 28 in the mid or "steady" feed position.

Continued pulling of the dancer arm 28 downwardly, engages the brake 20 which, in turn, begins to slow rotation of coil C, and eventually stops rotation thereof. Moreover, as demand from the strapping machine drops to zero, the accumulation region 84 fills, again, as seen in FIG. 2.

Those skilled in the art will recognize the various arrangements, configurations and structures by which the braking means, roller means, chute means and other disclosed functions can be carried out, which other arrangements, configurations and structures are within the scope and spirit or the present invention.

As set forth above, the present dispenser 10 also permits ready replacement or change out of the coils C. As will be appreciated by those skilled in the art, this change out can be carried out on one of the coils while the dispenser in operation feeding strapping material from the other coil. To this end, the change out of either coil is carried out with the entire dispenser 10 in an upright orientation to permit continued operation. To replace one of the coils, the appropriate hub 24 is removed from the spindle 16. The hub 24 can be of the threaded or bolted type. Other mechanical fastening arrangements can also be used. With the hub 24 removed, the outer or side plate 22 is likewise removed, providing access to the coil C. The empty coil is then removed and a replacement is positioned on the spindle 16. The side plate 22 is then replaced, as is the hub 24, which is secured in place. The dispenser is then ready to feed strapping material S from the replaced coil C.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A multiple coil dispenser for supporting at least two associated coils and for dispensing a flexible material from one of the coils, comprising:

a frame;

at least one coil support for supporting the associated coils for rotation;

a fixed arm, the fixed arm having a plurality of rollers positioned longitudinally therealong;

a movable arm, the movable arm movable toward and away from the fixed arm, the movable arm having a plurality of rollers positioned longitudinally therealong;

a bifurcated strap chute mounted on the frame, the strap chute having two feed sections and an outlet section;

a biasing element operably connected to the movable arm to move the movable arm away from the fixed arm; and a brake assembly operably connected to the movable arm between an engaged position when the movable arm is moved away from the fixed arm and a disengaged position when the movable arm is moved toward the fixed arm, wherein a space between the fixed arm and the movable arm defines an accumulation region, and wherein the accumulation region varies in size as the movable arm moves toward and away from the fixed arm.

2. The multiple coil dispenser in accordance with claim 1 wherein the movable arm is pivotally mounted to the frame for moving toward and away from the fixed arm.

3. The multiple coil dispenser in accordance with claim 1 wherein the brake assembly includes a sheave mounted for rotation with the associated coils and a braking element fixedly mounted to the dispenser at a first end and movably mounted at a second end, the braking element configured to apply a braking force to the sheave to stop rotation of the coil.

4. The multiple coil dispenser in accordance with claim 3 wherein the braking element assembly second end is mounted to the moving arm.

5. The multiple coil dispenser in accordance with claim 1 wherein the fixed arm rollers and the movable arm rollers are disposed on their respective arms to nest with one another when the movable arm is disposed adjacent the fixed arm.

6. The multiple coil dispenser in accordance with claim 1 including at least one retainer brush disposed to contact at least one of the rollers.

7. The multiple coil dispenser in accordance with claim 1 including a plurality of retainer brushes each associated with a roller.

8. The multiple coil dispenser in accordance with claim 6 wherein others of the rollers include a secondary roller for retaining the flexible material on the roller.

9. The multiple coil dispenser in accordance with claim 1 including a central support, wherein at least one brake assembly is mounted to the central support intermediate first and second coil supports.

10. The multiple coil dispenser in accordance with claim 9 wherein the fixed and movable arms are mounted to the central support.

11. The multiple coil dispenser in accordance with claim 1 wherein the feed sections include first and second reversing helical sections.

12. The multiple coil dispenser in accordance with claim 11 wherein the first and second reversing helical sections are in mirror image relation to one another.

13. A multiple coil dispenser for supporting at least two associated coils and for dispensing a flexible material from one of the coils, comprising:

a frame;

at least one coil support for supporting the associated coils for rotation;

a fixed arm;

roller means disposed on the fixed arm;

a movable arm, the movable arm movable toward and away from the fixed arm;

roller means disposed on the movable arm;

chute means mounted on the frame for feeding the flexible material from the coils to the arms, the chute having two feed sections connected to an outlet section in a bifurcated manner;

a biasing clement operably connected to the movable arm to move the movable arm away from the fixed arm; and means for braking the coils, wherein a space between the fixed arm and the movable arm defines an accumulation region, and wherein the accumulation region varies in size as the movable arm moves toward and away from the fixed arm.

14. The multiple coil dispenser in accordance with claim 13 wherein the means for braking the coils is actuated by movement of the movable arm.

15. The multiple coil dispenser in accordance with claim 13 wherein the means for braking is effected by an increase in the size of the accumulation region.

16. The multiple coil dispenser in accordance with claim 13 wherein the roller means is a plurality of rollers disposed on the fixed arm.

17. The multiple coil dispenser in accordance with claim 16 wherein the plurality of rollers are disposed along a longitudinal axis of the fixed arm.

18. The multiple coil dispenser in accordance with claim 13 wherein the roller means is a plurality of rollers disposed on the movable arm.

19. The multiple coil dispenser in accordance with claim 18 wherein the plurality of rollers are disposed along a longitudinal axis of the movable arm.

20. The multiple coil dispenser in accordance with claim 13 including sweeping means associated with at least some of the roller means.

21. A multiple coil dispenser for supporting at least two associated coils and for dispensing a flexible material from one of the coils, comprising:

a frame having a support for supporting a pair of associated coils for rotation;

a fixed, upwardly angled arm, the fixed arm having a plurality of rollers positioned longitudinally therealong;

retainers associated with at least some of the fixed arm rollers.

a movable arm, pivotable toward and away from the fixed arm, the movable arm having a plurality of rollers positioned longitudinally therealong, the fixed arm rollers and the movable arm rollers disposed on their respective arms to nest with one another when the movable arm is disposed adjacent the fixed arm;

retainers associated with at least some of the movable arm rollers;

a bifurcated strap chute mounted on the frame, the strap chute having two feed sections and an outlet section, the feed sections including first and second reversing helical sections;

a biasing element operably connected to the movable arm to bias the movable arm away from the fixed arm; and a brake assembly including a brake member mounted for rotation with the associated coils and a braking element fixedly mounted at a first end and mounted at a second end to the movable arm, the braking element configured to apply a braking force to the brake member to stop rotation of the coils when the movable arm is pivoted away from the fixed arm, wherein a space between the fixed arm and the movable arm defines an accumulation region that varies in size as the movable arm moves toward and away from the fixed arm.

22. The multiple coil dispenser in accordance with claim 21 wherein at least one of the retainers is a retainer brush disposed to maintain contact between a strap positioned on its associated roller and its associated roller.

23. The multiple coil dispenser in accordance with claim 21 wherein at least one of the retainers is a secondary roller disposed to maintain contact between a strap positioned on its associated roller and its associated roller.

24. The multiple coil dispenser in accordance with claim 21 wherein the first and second reversing helical sections are in mirror image relation to one another.

* * * * *